United States Patent [19]

Dobo

[11] 4,118,225

[45] Oct. 3, 1978

[54] METHOD FOR PRODUCING FIBROUS STEEL MATTS

[75] Inventor: Emerick J. Dobo, Cary, N.C.

[73] Assignee: Monsanto Company, St. Louis, Mo.

[21] Appl. No.: 626,155

[22] Filed: Oct. 28, 1975

[51] Int. Cl.[2] ..... B22F 3/00

[52] U.S. Cl. ..... 75/207; 75/211; 75/221; 75/224; 75/DIG. 1; 428/568; 75/229

[58] Field of Search ..... 75/211, 207, DIG. 1, 75/221, 224, 229; 264/63; 428/568

[56] References Cited

U.S. PATENT DOCUMENTS

| | | | |
|---|---|---|---|
| 3,529,044 | 9/1970 | Santangelo | 264/66 |
| 3,671,228 | 6/1972 | McIntire et al. | 75/214 |
| 3,697,262 | 10/1972 | Fenner | 75/207 |
| 3,846,527 | 11/1974 | Winter et al. | 264/63 |
| 3,950,478 | 4/1976 | Kenworthy et al. | 264/63 |
| 4,010,233 | 3/1977 | Winter et al. | 264/63 |

FOREIGN PATENT DOCUMENTS

| | | | |
|---|---|---|---|
| 45-28692 | 9/1970 | Japan | 75/207 |

*Primary Examiner*—Brooks H. Hunt
*Attorney, Agent, or Firm*—Howard C. Stanley; James W. Williams, Jr.; Russell E. Weinkauf

[57] ABSTRACT

A method is disclosed for making fibrous steel webs or matts from particulate iron oxides with the aid of a fiber-forming acrylic polymer. A plurality of continuous filaments are first formed by wet spinning an acrylic polymer spin dope in which particles of iron oxide are dispersed. The filaments obtained are then converted into a precursor web or matt by conventional textile procedures. This is followed by exposing the precursor to a reducing atmosphere (e.g., a gaseous mixture of hydrogen and carbon monoxide) at a temperature in the range of from about 900° C to 1150° C for a period of about 3 to 8 minutes. Under these conditions, the iron oxide particles are reduced to the metallic state and the polymer in the precursor is pyrolized to carbon and by-product gases. The carbon in the system diffuses into the resulting iron, and the individual metal particles sinter to form a matt of steel wire having a configuration essentially corresponding to that of the precursor.

10 Claims, No Drawings

METHOD FOR PRODUCING FIBROUS STEEL MATTS

This invention relates to a novel method for producing fibrous steel matts and the products obtained thereby. Such products are useful as a filter material, with the temperature resistance of steel offering particular advantages in this application. The products are also eminently suited for use as the reinforcing component in composite materials.

In my copending application Ser. No. 624,076 filed on Oct. 20, 1975 and titled, "Method for Making Steel Wire," which is incorporated herein by way of reference, a procedure is disclosed for making filamentary steel wire from particulate iron oxides with the aid of a fiber-forming acrylic polymer. This is accomplished by employing wet-spinning techniques, such as are commonly used in the textile arts for the production of acrylic fibers. That is, a spinning dope is first made up which contains particles of iron oxide uniformly dispersed in an acrylic polymer solution, and wherein the ratio by weight of iron oxide to acrylic polymer is in the range of from about 3:1 to 7:1. The iron oxide containing acrylic polymer dope is then spun through a spinnerette and directly into a coagulation bath to form precursor filaments. Conversion of the filamentary precursor to steel wire is accomplished by exposing the filaments to a reducing atmosphere (e.g., a gaseous mixture of hydrogen and carbon monoxide) for a period of from about 3 to 8 minutes at a temperature in the range of from about 900° C. to 1150° C. Under these conditions, the iron oxide particles are reduced to the metal state, and the polymer in the precursor is pyrolized to carbon and by-product gases. The carbon is absorbed by the metallic iron, and the individual particles sinter to form continuous steel wire.

The precursor filaments may be drawn or stretched after being formed in the coagulation bath to improve their tenacity for further handling. In addition, the toughness of the filaments may be improved by a shrinking operation which can be conducted immediately subsequent to the drawing procedure.

It has now been found that a non-woven web or matt can be produced by conventional procedures from the iron oxide containing acrylic filaments obtained in accordance with the above method, and that such non-woven structure is convertible to a corresponding fibrous steel matt or web in the same manner and under the same conditions as described above for converting precursor filaments to steel wire.

In the context of this invention, the term "acrylic polymer" refers to a fiber forming polymer and includes polyacrylonitrile and copolymers and terpolymers of acrylonitrile. That is, those copolymers and terpolymers are included which are obtained by polymerizing acrylonitrile with monomers such as vinyl acetate, methyl acrylate, vinyl pyridine and others which are known by those skilled in the art to be polymerizable with acrylonitrile to give satisfactory fibers and filaments.

As used herein, the term "iron oxide" is intended to include both hematite ($Fe_2O_3$) and magnetite ($Fe_3O_4$) or mixtures thereof.

For the purposes of this invention, the iron oxide needs to be in particulate form, and in order to achieve the density desired in the ultimate product the metal particles should possess a good distribution in particle size. However, the average diameter of the particles should not exceed about 5 microns, with an average diameter of about 1 micron or less being usually preferred.

In making up the spin dope from which the filaments are produced, the iron oxide particles are incorporated into a typical acrylic polymer spinning solution in the form of a uniform dispersion. The solvent may be selected from those commonly used in the wet-spinning of acrylic polymers (e.g. dimethylacetamide, dimethylformamide and dimethylsulfoxide) with the ratio by weight of solvent to polymer being in the range of from 3.5:1 to 6:1, and preferably 3.8:1 to 4.5:1, respectively. The iron oxide particles are added in an amount such that the ratio by weight of metal oxide to acrylic polymer is in the range of about 3:1 to 7:1, respectively. Although not required, it is sometimes advantageous to add small amounts of a wetting agent to the dope (e.g., less than 1.0% by weight of sorbitan monopalmitate). Following make-up, the dope components are mixed by well known methods to solubilize the polymer and to obtain a uniform dispersion of the metal oxide.

Filamentary structures are formed from the aforedescribed spin dope by continuously extruding the dope through a desired number of shaped orifices in a spinnerette and directly into a coagulation bath. The pressures required to give satisfactory extrusion rates are nominal and generally do not exceed 50 psig, with the normal range being from about 10 to 50 psig.

As is typical in the wet-spinning of acrylic fibers, the coagulation bath contains both a precipitant and a solvent for the acrylic polymer. The precipitant or coagulant is generally either water or ethylene glycol. And although a wide variety of solvents are applicable, solvents such as dimethylacetamide, dimethylformamide and dimethylsulfoxide often are of preference both in acrylic fiber spinning and in the practice of this invention. For convenience, it is usually desirable to employ the same solvent as was used in preparing the spinning dope.

For the purposes of this invention a binary mixture of water and dimethylacetamide or ethylene glycol and dimethylacetamide is usually preferred. When employing the former the solvent is generally present in the range of from about 30 to 70 percent by volume, with from 50 to 60 percent being preferred. When employing ethylene glycol as the coagulant in lieu of water, the dimethylacetamide solvent generally constitutes from about 15 to 85 percent by volume of the mixture, with from about 40 to 60 percent being preferred.

With water/dimethylacetamide systems the bath temperatures are those conventionally employed and can range between 28° C. to 70° C., with from about 35° C. to 60° C. being preferred. In the case of ethylene glycol/dimethylacetamide mixtures, the bath temperature may range between 0° C. to 95° C., with from 10° C. to 30° C. being usually preferred. An especially preferred coagulation system is one comprised of a mixture of ethylene glycol and a dimethylacetamide solvent, with the solvent constituting from about 40 to 60 percent by volume of the mixture. In operation, the coagulating bath containing these components is preferably maintained at a temperature in the range of from about 10° C. to 30° C.

The coagulation step may if desired be followed by a polymer orientation step in which the filaments are stretched from about 1 to 3 times their initial length in a conventional hot water or boiling water stretch bath.

This orientation and attenuation procedure, which greatly improves filament strength, is generally referred to as a "hot cascade" stretch. Stretching is accomplished by correlating the linear entry rate of the filaments into the stretch bath with the rate of withdrawal. When the latter is at a higher rate, stretching of the filament will, of course, occur.

Although again optional, further advantages can be realized by following the stretching operation with a shrinking step. This is also accomplished by passing the filaments continuously through a hot or boiling water bath. However, in contrast to the stretching procedure, the filaments are withdrawn from the bath at a speed sufficiently slower than the feed speed to allow relaxation and shrinkage to occur. The extent of shrinkage is usually much less than the stretch originally imparted. In general, the ratio of the length of the filaments before and after shrinking is in the range of from about 1:0.9 to 1:0.7, respectively. When subjected to this relaxation and shrinking procedure, the filaments exhibit a greater toughness.

From the iron oxide laden acrylic filaments thus obtained, a non-woven, self-sustaining web or matt is formed to serve as the precursor to the ultimate product. This may be accomplished by any of the conventional methods commonly employed in the Textile Industry for producing non-woven fabrics, which have become increasingly important because of their low cost of manufacture, as compared to the cost of fabrics formed by weaving or knitting span fibers. One widely used method comprises producing a more or less tenuous web of loosely associated carded fiber staple, followed by the lamination of several of these card webs together to form a somewhat more self-sustaining sheet. This essentially two-dimensional web or sheet of fibers has its fibers substantially parallelized or oriented in the "machine direction," i.e., the direction in which the product moves continuously from the sheet-forming machine. In such a web, the degree of fiber orientation may range from about 70 to about 90 percent, with the remainder of the fibers being "non-oriented" or more or less randomly disposed in overlapping arrangement.

Other known methods for preparing non-woven webs or matts comprise the use of fluids such as air or water to deposit the staple fibers and form a web wherein the fibers are in a haphazard intersecting arrangement. When using the air system, special pneumatic web forming machines, such as the Rando-Webber, are generally employed. Since the webs obtained by these and other conventional methods are not basically self-sustaining as initially formed, they are subjected to various bonding operations such as, for example, solvent bonding or impregnation with a binder.

Conversion of the precursor matt to a fibrous steel matt is accomplished by exposing the precursor to a reducing atmosphere at a temperature in the range of from about 900° C. to 1150° C. over a time span of from about 3 to 8 minutes. Under these conditions, the iron oxide particles are reduced to iron, and the acrylic polymer in the precursor is converted to carbon and by-product gases. The carbon diffuses into the metallic iron, and the individual metal particles sinter to form a fibrous steel matt having a configuration essentially corresponding to that of the precursor from which it was formed.

It has been found that good results are achieved when the reducing atmosphere is comprised of a gaseous mixture consisting of from about 80 to 98 percent by volume of hydrogen, from 2 to 15 percent by volume of carbon monoxide and from 0 to 10 percent by volume of a carburizing gas. In addition to contributing to the reduction of iron oxide to iron, the carbon monoxide serves to control the diffusion of carbon into iron. Although not essential, a carburizing gas may be included in the reducing atmosphere to provide an additional source of carbon to further enhance the tensile strength of the ultimate fibrous steel matt product. When used, the carburizing gas may be selected from the hydrocarbon gases commonly used in the steel industry to supply a quantity of carbon for absorption and diffusion into steel. Included among such gases are methane, ethane, propane and butane, with methane and propane being expecially preferred.

In a preferred mode for carrying out the conversion step of the process, the precursor is continuously processed through an elongated furnace which has been heated to an appropriate temperature. The reducing gas mixture is caused to flow into the furnace in a reverse direction to the direction of movement of the precursor feed. In this manner the fibrous steel matt being formed never "sees" an oxidizing environment until the process is complete and the product exits the furnace to a take-up device.

The steel fibers obtained in the ultimate product have been found to have a ferrite/pearlite exhibiting a relatively fine grain structure. By converting to a tempered martensite, substantial increases in tensile strength are realized. This can be accomplished by well-known methods which involve heating the product to the austenitic temperature, quenching and then tempering.

To further supplement the description of this invention, the following example of an actual run is presented.

EXAMPLE

One thousand grams of hematite ($Fe_2O_3$) and 212.1 grams of a copolymer consisting of 93 percent by weight of acrylonitrile and 7 percent by weight of vinyl acetate were intimately mixed in a rod mill for 10 hours. Thereafter, a solvent mix consisting of 850 cc of dimenthylacetamide, 0.5 cc of ethylene glycol and 1.2 cc of sorbitan monopalmitate was chilled to 10° C. and placed into a large Waring blender. The mixture of iron oxide and polymer was then also transferred to the blender and stirred in by hand to give a fairly uniform mixture. The solvent was pre-chilled to reduce its solvency so that the polymer could be dispersed mechanically with limited amounts going into solution. The Waring blender was then brought to high speed and further blending of the oxide and complete solution of the polymer took place. The blender was turned off when a final temperature of 42.5° C. was attained as sensed by a thermocouple in the mixture. The heat for the temperature rise resulted from the degradation of mechanical energy supplied by the blending device. During the mixing period, a vacuum of 22 inches of mercury was pulled on the contents of the blender to reduce the amount of air entrapment in the mixture.

The spinning dope thus prepared was transferred to the dope pot of a standard wet-spinning line where it was subjected to a vacuum of 22 inches of mercury for one-half hour and then pressurized to 35 psi. for one-quarter of an hour. This step was undertaken to again reduce entrained air that could cause voids in the fibers produced. A positive displacement pump delivered 15.6 cc per minute of the dope through a cup spinnerette which had five holes each of 20 mils in diameter. Upon emerging from the spinnerette, the dope thread lines entered a coagulation bath which was at a temperature of 24° C. The coagulation system employed consisted of a mixture of 50.2 percent by volume of ethylene glycol and 49.8 percent by volume of dimethylacetamide. An acrylic plasticizer (N,N-dimethyl lauramide) was also present in the bath in an amount of 0.1 percent by weight based on the weight of the coagulating mixture. The thread line was taken up at a first godet (thread advancing rolls) at 20 feet per minute and washed with the bath solution to continue the gentle coagulation process. A second godet received the thread line at the rate of 20 feet per minute. Here the thread line was washed with water to complete the coagulation. Then the thread line was stretched in boiling water to orient the filaments. This step occurred between the second and the third godet which rotated at a rate of 50 feet per minute. Relaxation and a consequent shrinking of the filaments occurred in boiling water between the third and fourth godet which rotated at the rate of 40 feet per minute. On leaving the fourth godet, the filamentary thread line was taken up on a Leesona winder.

From the iron oxide laden filaments obtained, a non-woven matt was produced by the conventional wet lay-down system. The filaments were first cut into ½ inch lengths and a water slurry of the resulting short fibers was formed. The slurry was then filtered to form a compact fibrous matt or pad. To provide dimensional stability, the matt was solvent bonded with a solution containing 95 percent by volume of dimethylacetamide and 5 percent by volume of water. The bonding solution was sprayed on the matt after which the matt was washed with water to fix the bonds at the fiber cross-over points.

The bonded matt structure was then continuously fed into one end of an elongated furnace while a mixture of reducing gases was introduced into the furnace at the end opposite to that of the feed entry. The furnace was maintained at a temperature of 1075° C., the reducing gas mixture consisted of 94 percent by volume of hydrogen and 6 percent by volume of carbon monoxide, and the dwell time of the fibrous matt in the furnace was approximately 5 minutes.

The fibrous steel matt obtained essentially retained the structural characteristics of the precursor matt. It had a tight porous character with metal fibers interlaced with other metal fibers.

Although the invention has been described with particular reference to fibrous steel matts, the method is also fully applicable to the production fibrous matts comprised of an alloy of steel. This is readily accomplished by merely combining one or more other metal oxides with iron oxide when making up the spin dope used to form the filaments from which the precursor matt is formed. Such spin dope will then contain a mixture of metal oxide particles dispersed in the acrylic polymer solution, with the particles having an average diameter of 5 microns or less. The weight ratio of combined metal oxide to acrylic polymer should be in the range of from about 3:1 to 7:1. Any metal oxide may be used in combination with iron oxide so long as the range of conditions by which it may be reduced and sintered over lap with those of iron oxide. Among others, nickel oxide and cobald oxide are examples of compounds which may be suitably combined with iron oxide to produce fibrous matts comprised of steel alloy fibers. The proportions of the various metal oxides can be widely varied according to the properties desired in the ultimate product.

Although the invention has been described with respect to details of the preferred embodiments, many modifications and variations which clearly fall within the scope of the invention as defined by the following claims will become apparent to those skilled in the art.

I claim:

1. A method for producing a fibrous steel matt from particles of iron oxide with the aid of a fiber-forming acrylic polymer, said method comprising the following steps in sequence:

(A) providing a spinning dope wherein particles of iron oxide having an average diameter of about 5 microns or less are uniformly dispersed in a solution of acrylic polymer with the weight ratio of iron oxide to acrylic polymer being within the range of from about 3:1 to 7:1, respectively;

(B) forming a plurality of continuous filaments by extruding said dope through a spinnerette and into a coagulation bath;

(C) forming a non-woven precursor matt from said filaments; and (D) converting said precursor matt to a fibrous steel matt by subjecting the precursor to a temperature in the range of from 900° C. to 1150° C. for a period of from about 3 to 8 minutes while being exposed to a gaseous atmosphere consisting of from about 80 to 94 percent by volume of hydrogen, from about 2 to 15 percent of carbon monoxide and from 0 to 10 percent by volume of a gaseous hydrocarbon.

2. The method in accordance with claim 1, wherein said iron oxide is selected from the group consisting of hematite, magnetite or mixtures of hematite and magnetite.

3. The method in accordance with claim 1, wherein said acrylic polymer is a copolymer consisting of 93 percent by weight of acrylonitrile and 7 percent by weight of vinyl acetate.

4. The method in accordance with claim 1, wherein the solvent in said solution of acrylic polymer is dimethylacetamide.

5. The method in accordance with claim 1, wherein said coagulation bath consists essentially of 40 to 60 percent by volume of ethylene glycol and 60 to 40 percent by volume of dimethylacetamide.

6. A method for producing a fibrous steel matt from particles of iron oxide with the aid of a fiber-forming acrylic polymer, said method comprising the following steps is sequence:

(A) providing a spinning dope wherein particles of iron oxide having an average diameter of about 5 microns or less are uniformly dispersed in a solution of acrylic polymer with the weight ratio of iron oxide to acrylic polymer being within the range of from about 3:1 to 7:1, respectively;

(B) forming a plurality of continuous filaments by extruding said dope through a spinnerette and into a coagulation bath;

(C) stretching said filaments from about one to three times their initial length in a boiling water bath;

(D) shrinking said filaments in a boiling water bath such that the ratio of their length before and after shrinking is in the range of from 1:0.9 to 1:0.7, respectively;

(E) forming a non-woven precursor matt from said filaments; and (F) converting said precursor matt to a matt of fibrous steel by exposing said precursor to a gaseous atmosphere consisting of from about 80 to 94 percent by volume of hydrogen, from about 2 to 15 percent by volume carbon monoxide, and from 0 to 10 percent by volume of a gaseous hydrocarbon at a temperature in the range of from about 900° C. to 1150° C. for a period of from about 3 to 8 minutes.

7. A precursor matt which is convertible to a fibrous steel matt when exposed to a reducing environment at a temperature in the range of from about 900° C. to 1150° C. for a period of from about 3 to 8 minutes, said precursor matt being composed of fibers which contain a mixture of iron oxide particles and an acrylic polymer in a weight ratio of from about 3:1 to 7:1, respectively.

8. A fibrous steel matt produced in accordance with the method of claim 1.

9. A method for producing a fibrous steel alloy matt from a mixture of metal oxide particles consisting of iron oxide and one or more other metal oxides capable of being reduced and sintered at conditions effective for accomplishing a reduction and sintering of iron oxide, said method comprising the following steps in sequence:

(A) providing a spinning dope wherein said mixture of metal oxide particles having an average diameter of about 5 microns or less are uniformly dispersed within a solution of acrylic polymer with the weight ratio of iron oxide to acrylic polymer being within the range of from about 3:1 to 7:1, respectively;

(B) forming a plurality of filaments by extruding said dope through a spinnerette and into a coagulation bath;

(C) converting said precursor matt to a fibrous steel alloy matt by exposing said precursor to a gaseous atmosphere consisting of from about 80 to 94 percent by volume of hydrogen, from about 2 to 15 percent by volume of carbon monoxide, and from 0 to 10 percent by volume of a gaseous hydrocarbon at a temperature in the range of from about 900° C. to 1150° C. for a period of from about 3 to 8 minutes.

10. A fibrous steel alloy matt produced in accordance with the method of claim 9.

* * * * *